US006758271B1

(12) United States Patent
Smith

(10) Patent No.: US 6,758,271 B1
(45) Date of Patent: Jul. 6, 2004

(54) SYSTEM AND TECHNIQUE TO IMPROVE A WELL STIMULATION PROCESS

(75) Inventor: David Randolph Smith, Houston, TX (US)

(73) Assignee: Sensor Highway Limited, Southampton (GB)

( * ) Notice: Subject to any disclaimer, the term of this patent is extended or adjusted under 35 U.S.C. 154(b) by 34 days.

(21) Appl. No.: 10/219,950

(22) Filed: Aug. 15, 2002

(51) Int. Cl.[7] ..... E21B 47/06; E21B 43/26; E21B 49/00

(52) U.S. Cl. ..... 166/250.1; 166/305.1; 166/308.1; 73/152.55

(58) Field of Search ..... 166/250.1, 305.1, 166/308; 702/6, 9; 73/152.55, 152.12, 152.18

(56) References Cited

U.S. PATENT DOCUMENTS 4,979,151 A * 12/1990 Ekstrom et al. ..... 367/35
5,241,475 A * 8/1993 Lee et al. ..... 702/12
5,582,064 A * 12/1996 Kluth ..... 73/1.57
5,804,713 A * 9/1998 Kluth ..... 73/152.01
5,892,176 A * 4/1999 Findlay et al. ..... 174/115
5,992,250 A * 11/1999 Kluth et al. ..... 73/866.5
6,176,323 B1 * 1/2001 Weirich et al. ..... 175/40
6,281,489 B1 * 8/2001 Tubel et al. ..... 250/227.14
RE38,052 E * 4/2003 Kluth ..... 73/1.57
6,609,067 B2 * 8/2003 Tare et al. ..... 702/9
6,618,677 B1 * 9/2003 Brown ..... 702/13
6,640,900 B2 * 11/2003 Smith ..... 166/336
2002/0163639 A1 * 11/2002 Stephenson ..... 356/301
2003/0050758 A1 * 3/2003 Soliman et al. ..... 702/6
2003/0122535 A1 * 7/2003 Williams et al. ..... 324/107

OTHER PUBLICATIONS

Sakaguchi et al, Temperature Logging By The Distributed Temperature Sensing Technique During Injection Tests, May 28–Jun. 10, 2000, Proceedings World Geothermal Congress 2000, entire document.*

* cited by examiner

*Primary Examiner*—David Bagnell
*Assistant Examiner*—T. Shane Bomar
(74) *Attorney, Agent, or Firm*—Wayne I. Kanak; Jaime A. Castano; Jeffrey E. Griffin

(57) ABSTRACT

A technique that is usable with a subterranean well includes introducing a fluid into the well in connection with a fluid efficiency test. The technique also includes measuring a temperature versus depth distribution along a section of the well in response to the introduction of the fluid.

73 Claims, 6 Drawing Sheets

SYSTEM AND TECHNIQUE TO IMPROVE A WELL STIMULATION PROCESS

BACKGROUND

The invention generally relates to a system and technique to improve a well stimulation process.

For purposes of preparing a well for production, a perforating gun typically is lowered down into a well's casing wellbore to form perforation tunnels. These perforation tunnels extend through the casing, cement grout and into the formation(s) that are exposed by the drilling of the wellbore. In this manner, the perforating gun includes shaped charges that when detonated produce the corresponding perforation tunnels. The perforation tunnels allow reservoir fluids to flow from the formations through the perforation tunnels and into the well bore. Subsequent to the perforating operation by the perforating gun, a fracturing operation may be performed for purposes of increasing the well's ability to produce fluids from the reservoirs to maximize production.

In a typical fracturing operation, a fracturing fluid is introduced into the well and then pressurized. This pressurization of fluid creates fractures in the subterranean rock. The pumping of fluids down the well and into these fractures transports particulates, called proppant, into the fractures, and hence, when the fluid pressure is released the fractures do not close but remain open due to the proppant particles now being in the rock fractures. Likewise, fracturing fluids can contain chemicals and particles that etch the face of the newly created hydraulic fractures, or the chemicals in the hydraulic fracture process otherwise increase the reservoir's ability to conduct reservoir fluids to the well bore such that once the hydraulic pressure is released, the hydraulic fractures remain as improved paths of fluid conductivity to the reservoir.

The proppant-laden fluid may be quite expensive, and typically, the fracturing operation that uses this proppant-laden fluid is a one-time operation for the well. Thus, it is important for the fracturing to be effective. The effectiveness of the fracturing operation typically depends on a plurality of parameters, including the quality of the perforation tunnels, the ability of the adjacent reservoir rock to accept fracture fluids and the rock's fluid loss characteristics. It is common practice to perform a fluid efficiency test, which does not include the proppant particles, to evaluate the fracture fluids fluid loss characteristics to the reservoir rock. During the fluid efficiency test, the pressure of the test fluid at the surface of the well is observed. In this manner, increases and decreases in the surface pressure of the test fluid may be monitored before and after introduction to assess the general fluid efficiency of the hydraulic fracture fluid design as it relates to the in-situ rock properties leak off properties.

Based on the assessment provided by the fluid efficiency test, the reservoir rock may be subsequently treated in-situ before pumping of the proppant laden fracture fluids. Such a technique may save expenses related to fracturing operations cost as a higher than expected fluid loss rate or spurt fluid loss discovered in the fluid efficiency pumping test can be accommodated by redesigning the proppant-laden fracturing fluid prior to the fracturing operation.

A potential difficulty that is associated with the above-described techniques is that the various perforation tunnels or zones of the well cannot be precisely evaluated as to if they are taking fluid or how much fluid, as the surface pressure measurement only provides a general assessment of the rock's leak off or spurt losses to the fluid used in the fluid efficiency test.

Alternatively, for a better resolution of where fluids are injected, radioactive fluids or solids may be mixed with the fluid used in the fluid efficiency test, and gamma ray logging may be subsequently used to obtain a more detailed evaluation of the fluid injection points by detecting the radioactive material. This radioactive tracer technique is not commonly used in fluid efficiency testing for two reasons. The first reason is that the use of radioactive materials is not something a prudent operator wishes to do on a frequent basis owing to the many regulatory and health and safety issues involved with the use and transport of these materials. And secondly, radioactive tracer technique does not indicate the relative volumes of fluids injected at any depth. Hence, the art of doing radioactive tracer injection on fluid efficiency tests is not commonly practiced. It is however practiced in the subsequent hydraulic fracture treatment where radioactive materials are mixed with the proppant-laden fluids and injected into the well. The subsequent gamma ray logs reveal the locations of the radioactive-tagged proppant. Therefore, this method of tagging the proppant during the pumping of proppant is not proactive and does not allow for one to adjust the injection profile prior to pumping the expensive proppant material.

Thus, there is a continuing need to address one or more of the problems stated above.

SUMMARY

In an embodiment of the invention, a technique that is usable with a subterranean well includes introducing a fluid into the well in connection with a fluid efficiency test. The technique also includes measuring a temperature versus depth distribution along a section of the well in response to the introduction of the fluid.

Advantages and other features of the invention will become apparent from the following drawing, description and claims.

DETAILED DESCRIPTION

Figure 1:
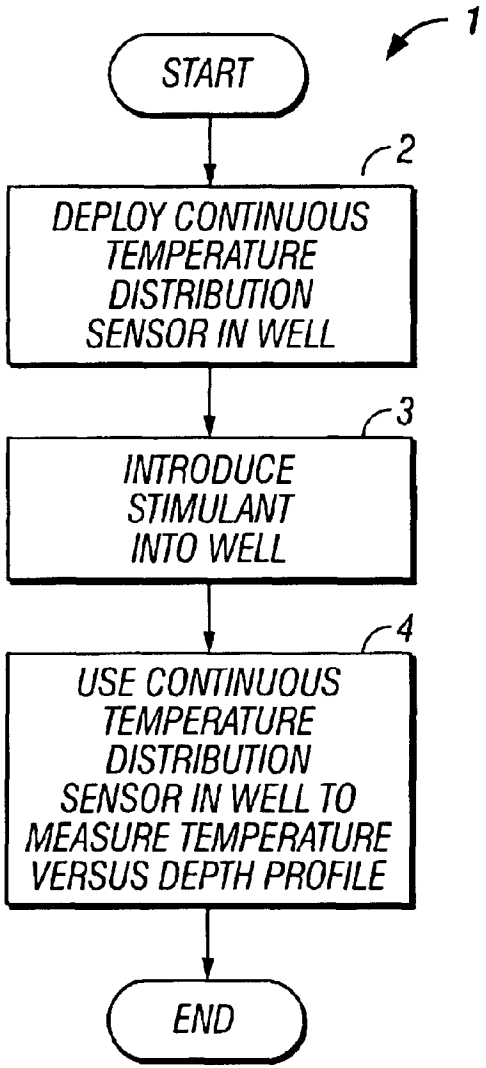
FIG. 1 is a flow diagram depicting a technique to monitor stimulation of a subterranean well according to an embodiment of the invention.

Referring to FIG. 1, an embodiment 1 of a technique in accordance with the invention may be used to measure a temperature versus depth distribution, or profile, of formation rock along a section of a well during a fluid efficiency test. This section of the well may include one or more production or injection zones (i.e., future production/injection zones).

In the fluid efficiency test, a test fluid without proppant is introduced into the well. The test fluid is generally cooler than the downhole reservoir rock temperature. The test fluid transports heat away from the rock that it contacts in the well, with a much larger cooling occurring in the perforated intervals where the fluid is pumped, as a function of the contact time of the test fluid with the rock. Hence, after the fluid efficiency injection test, there is a temperature transient that exists between the cooled down rock and the time it takes the rock to recover to the natural geothermal temperature. It is the temperature response time of the rock that indicates the volume of fluid placed at any depth of the well, and this transient time indicates volumes of fluids injected at all depths in the well.

Thus, by measuring the temperature versus depth distribution, the various zones of the well can be precisely evaluated as to whether the zones are taking fluid or how much fluid. This evaluation may then be used to decide whether corrective action may be taken. This corrective action may include redesigning the fracturing fluid, re-perforating selected zones of the well, performing an acid job or introducing ball sealers into the well, as just a few examples.

In the context of this application, a particular "production/injection zone" may include one or more perforation tunnels. Also, in the context of this application, the phrase "fluid efficiency test" refers to a test that is performed prior to a fracturing operation. In this manner, in the fluid efficiency test, a test fluid that may not contain proppant is introduced into the well.

Turning now to the technique 1, in some embodiments of the invention, the technique 1 includes deploying (block 2) downhole a temperature sensor that indicates a temperature versus depth distribution, or profile, along the length of the sensor. Thus, this temperature sensor indicates this distribution along the section of the well through which the sensor extends.

A sensor that indicates such a temperature versus depth distribution is referred to herein as a "distributed temperature sensor." As described below, in some embodiments of the invention, this distributed temperature sensor may be formed at least in part from at least one optical fiber. In this manner, for these embodiments of the invention, the optical fiber is deployed downhole in the well so that the optical fiber extends along various zones or sections of the well to be monitored.

After the distributed temperature sensor is deployed downhole, a test fluid is introduced (block 3) into the well in accordance with the technique 1 for purposes of performing a fluid efficiency test. Thus, this introduction of the test fluid occurs after the well has been perforated and before any fracturing operation. After introduction of the test fluid, the technique 1 includes using (block 4) the distributed temperature sensor to measure the temperature versus depth distribution, or profile, along a section of the well. Several of these measurements (i.e., several temperature versus depth profile "snapshots") may be taken in some embodiments of the invention, and these measurements may be taken over a time interval that begins before introduction of the test fluid and extends into the recovery of the well from the introduction of the test fluid. Thus, these measurements may be used to observe the transient temperature response of the formation rock in response to the introduction of the test fluid.

The formation rock near the wellbore undergoes a temperature change when the test fluid is introduced into the well because the test fluid is initially cooler than the temperature of the rock. Therefore, after its introduction into the well, the temperature of the formation rock rises. The temperature profile of the formation rock does not remain constant along the depth of the well, as the temperature at a particular point is a function of the well depth at that point and the volume capacity of the well at that point. Thus, accounting for changes in temperature due to well depth, it is the thermal recovery profile that serves as an indication of the volume capacity of the well, as described below. Therefore, the distributed temperature sensor's indication of the well temperature along its length permits the development of a graph that depicts the volume capacity of the well versus well depth. This graph, in turn, identifies potential problematic zones of the well.

Figure 2:
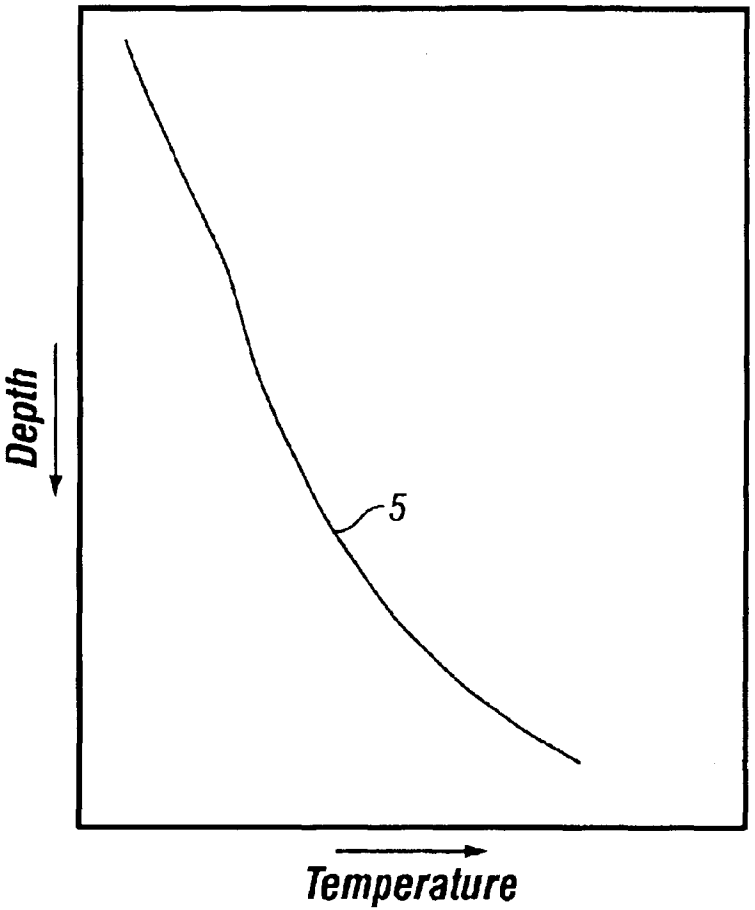
FIG. 2 depicts a temperature versus depth profile of a well depicting a static, geothermal gradient of the well.

Turning now to a more detailed discussion of the temperature versus depth profile in a well and how this profile is affected by the introduction of the test fluid, FIG. 2 depicts a temperature versus depth profile 5 of a well before the introduction of the test fluid. This profile 5 represents a static state of the well, often referred to as the geothermal gradient. As can be seen, the temperature of the formation rock near the wellbore generally increases with depth.

Figure 3:
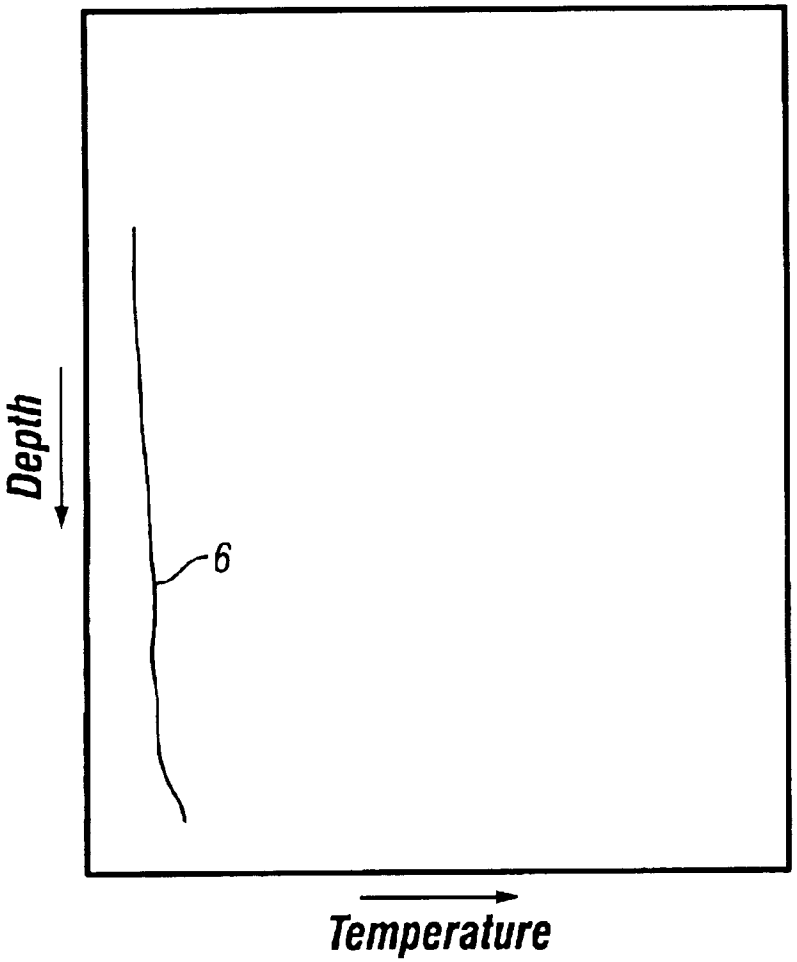
FIG. 3 depicts a temperature versus depth profile of the well shortly after the introduction of the test fluid according to an embodiment of the invention.

The temperature versus depth profile changes in response to the introduction of the test fluid. In this manner, FIG. 3 depicts a temperature versus depth profile 6 in the well just after the introduction of the test fluid into the well. As depicted, the profile. 6 is nearly vertical when the test fluid is first introduced into the well. However, referring to FIG. 4, after the test fluid's initial introduction, the well warms back up to produce a temperature versus depth profile 8. As shown, at this time, the well temperature does not resemble the general outline of the geothermal gradient due to volume fluctuations along the well depth. These volume changes, in turn, are attributable to the presence of perforation tunnels.

Figure 4:
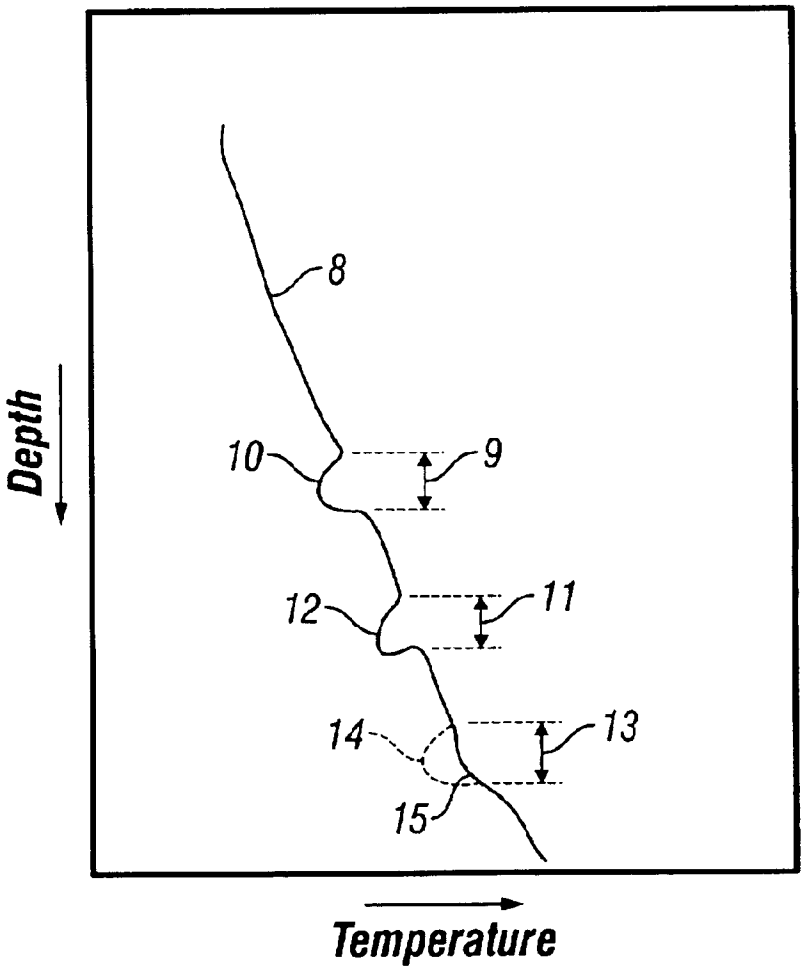
FIG. 4 depicts a temperature versus depth profile of the well depicting warming of the test fluid according to an embodiment of the invention.

More specifically, in the example that is depicted in FIG. 4, the profile 8 traverses three zones 9, 11 and 13 of the well. As depicted in FIG. 4, the zone 9 produces a recess, or depression 10, in the profile 8 as a result of the additional volume capacity (in the zone 9) that is introduced by the zone's perforation tunnels. The additional volume capacity in the zone 9 means that more test fluid is present in the zone 9, and as a result, the temperature in this zone 9 does not rise as quickly as the temperature in regions where the well has less volume capacity (i.e., less test fluid).

Similar to the depression 10, the profile 8 includes a depression 12 due to the perforation tunnels that are present in zone 11. However, for zone 13, the profile 8 has only a minor depression 15 that ideally should resemble a depression 14 that is represented by a dashed line in FIG. 4. The absence of a significant temperature drop in the zone 13 indicates that the lack of a sufficient volume capacity in the zone 13, i.e., the absence of adequate perforation tunnels in the zone 13.

Thus, the profile 8 indicates that corrective action may need to be taken for zone 13. This corrective action may include, as examples, a subsequent perforation of the zone 13, the introduction of acid into the zone 13, the introduction of ball sealers into the zone 13, etc.

To summarize, in some embodiments of the invention, test fluid is introduced into the well in connection with a fluid efficiency test. The deployed distributed temperature 5 sensor is then used to obtain a temperature profile that is monitored to observe the temperature response of formation rock to the introduction of the test fluid. Based on the monitored temperature, corrective action (if any) is performed. Subsequently, in accordance with some embodiments of the invention, a fracturing operation is performed in the well.

As apparent from the discussion above, a system that permits the measurement of a temperature versus depth distribution during a fluid efficiency test may give rise to one or more of the following advantages. The zones that are taking or are not taking the test fluid are easily located. The need for enhancements, or corrective action, for a particular zone may be identified prior to a fracturing operation. Relative volumes that separate perforated intervals in a well may be observed. Points along a horizontal section that have taken test fluids may be monitored. The effectiveness of a bridge plug that has been set between perforated intervals may be monitored. Other and different advantages are possible in the various embodiments of the invention.

Figure 5:
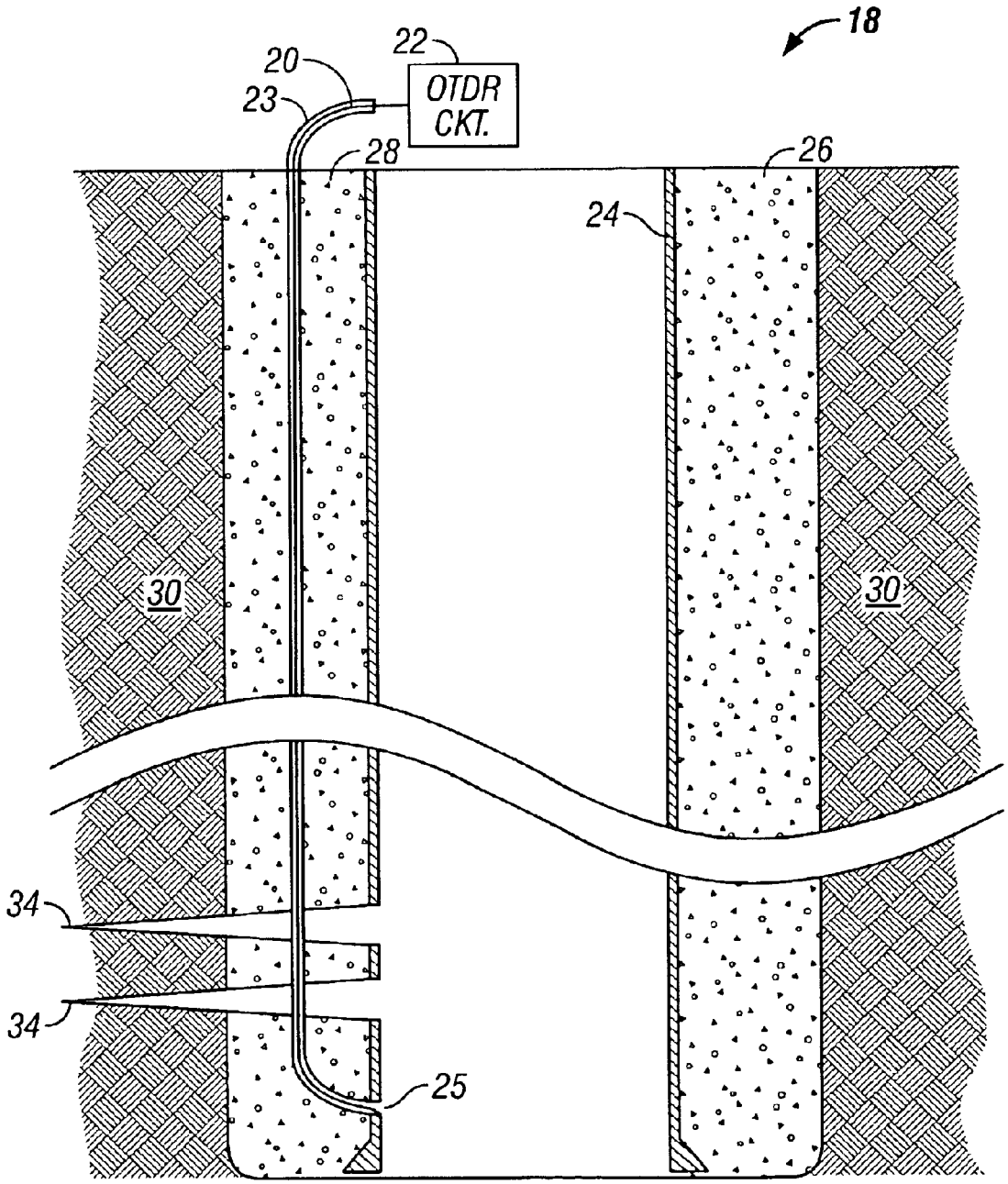
FIGS. 5, 8 and 9 are schematic diagrams of systems to measure temperature versus depth distributions according to different embodiments of the invention.

Referring to FIG. 5, in some embodiments of the invention, the above-described technique 1 may be performed in a well using a system 18. In this manner, the system 18 includes a well casing string 24 that extends through a wellbore that is formed in one or more subterranean formations 30. For purposes of measuring the temperature versus depth distribution, the system 18 includes a conduit 23 that extends into the well's annulus. The annulus is the annular region between the outside of the casing string 24 and the surrounding formation(s) 30.

The conduit 23 houses a distributed temperature sensor, such as at least one optical fiber 20, which extends downhole inside the central passageway of the conduit 23. The conduit 23 and optical fiber 20 pass through one, two or more zones of the well; and each of these zones include perforation tunnels, such as the depicted perforation tunnels 34. The conduit 23 may be deployed concurrently with the casing string 24, in some embodiments of the invention. As depicted in FIG. 5, the conduit 23 is cemented in place in the annulus of the well.

The cementing of the conduit 23 in place occurs before perforating and thus, before the formation of the perforation tunnels 34. Therefore, the perforating gun that is used to form the perforation tunnels 34 may include an orientation module that focuses the gun charges away from the conduit 23, thereby allowing for the perforation of the well in such a manner as to not penetrate the conduit 23. As examples, this orientation module may be a gyroscope or a device that locates a predefined feature of the casing string 24 to orient the shaped charges of the perforating gun away from the conduit 23.

In some embodiments of the invention, the conduit 23 has an outlet port 25 that opens into the central passageway of the casing string 24. This arrangement permits fluid to be circulated downhole through the conduit 23, and this circulation of fluid may be used for purposes of, for example, pumping the optical fiber 20 into the conduit 23 after the conduit 23 has been deployed and cemented in place in the annulus. The conduit 23 and port 25 may also be used for purposes of introducing the test fluid into the well; communicating fluid or fluid pressure downhole for purposes of controlling a downhole tool; or communicating fracturing fluid into the well, as just a few examples.

The conduit 23 is depicted in FIG. 5 and in some of the other figures as extending straight downhole. However, in other embodiments of the invention, the conduit 23 may terminate at a closed end and is not open to the central passageway of the casing string 24. In other embodiment, the conduit 23 may be U-shaped so that the outlet port 25 does not open into the central passageway of the casing string 24 but instead, is located at the surface of the well. Thus, with the U-shaped conduit 23, both the inlet and outlet ports of the conduit 23 are located at the surface of the well, thereby allowing fluid to be circulated through the conduit 23 for purposes of deploying the optical fiber 20 into conduit 23 without exposing the optical fiber 20 to harsh well fluids. The U-shaped conduit 23 further also permits the optical fiber 20 to have a U-shape, thereby doubling the length of optical fiber, relative to a straight conduit 23. This doubled length, in turn, increases the number of measurement points, described below, and therefore also increases the resolution of the system.

Depending on the particular embodiment of the invention, the conduit 23 may hang from an associated hanger at the surface of the well or alternatively, be secured to a tubing that extends downhole.

At the surface of the well, the optical fiber 20 is optically coupled to an optical time domain reflectometry (OTDR) circuit 22. The OTDR circuit 22 includes a light source to launch light pulses down the optical fiber 20 at a predefined rate. Generally, in one embodiment, pulses of light at a fixed wavelength are transmitted from the light source in OTDR circuit 22 down the optical fiber 20. The fiber 20 includes measurement points, and at every measurement point in the fiber 20, light is back-scattered and returns to the OTDR circuit 22 that detects this back-scattered light. Knowing the speed of light and the moment of arrival of the return signal, enables its point of origin along the optical fiber 20 to be determined. Temperature stimulates the energy levels of the silica molecules in the optical fiber 20. The back-scattered light contains upshifted and downshifted wavebands (such as the Stokes Raman and Anti-Stokes Raman portions of the back-scattered spectrum) which can be analyzed to determine the temperature at origin. In this way, the temperature of each of the responding measurement points in the optical fiber 20 can be calculated by the OTDR circuit 22, providing a complete temperature distribution along the length of the optical fiber 20. As previously explained, the optical fiber 20 may also have a surface return line so that the entire line has a U-shape. One of the benefits of the return line is that it may provide enhanced performance and increased spatial resolution to the temperature sensor system.

The backscattered light from these pulses indicates the temperature versus depth distribution along the length of the optical fiber 20 and is detected by a light sensor of the OTDR circuit 22. The OTDR circuit 22 processes the received indication from the optical fiber 20 using the principle of optical time domain reflectometry to generate an indication of a graph (on a display of the circuit 22, for example) of the temperature versus depth distribution. As an example, the OTDR circuit 22 may include a microprocessor, a light source, a light sensor, an analog-to-digital (A/D) converter, a digital-to-analog (D/A) converter, etc., as can be appreciated by those skilled in the art, for communicating light pulses with the optical fiber 20 and processing the information received from the optical fiber 20.

Figure 6:
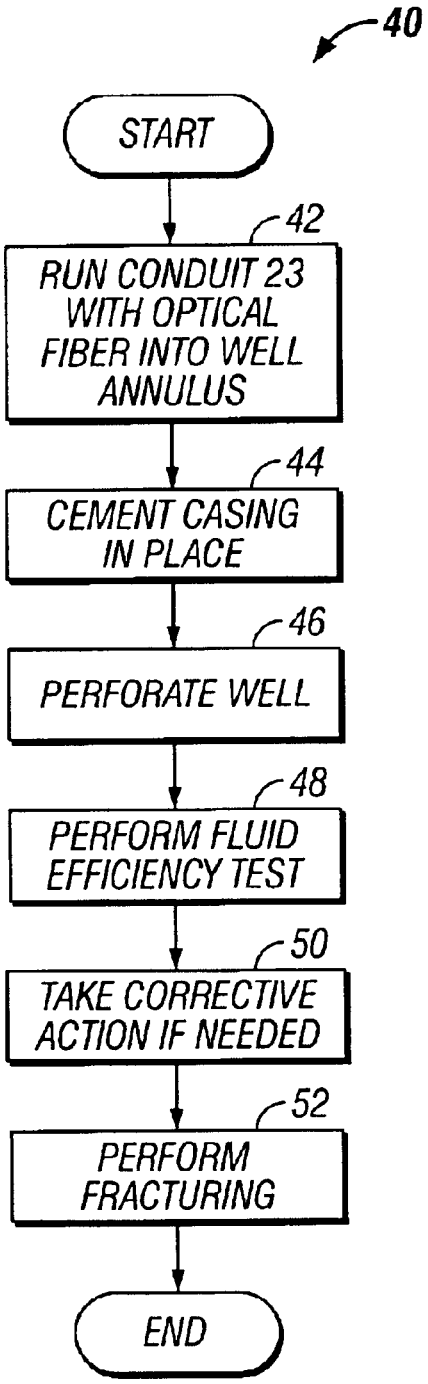
FIGS. 6 and 7 are flow diagrams depicting techniques to measure temperature versus depth distributions according to different embodiments of the invention.

Thus, in some embodiments of the invention, a technique 40 that is depicted in FIG. 6 may be used to measure the temperature versus depth distribution along the length of the optical fiber 20. This technique 40 includes running (block 42) the conduit 23 with the optical fiber 20 into the well annulus. As examples, the conduit 23 may be run downhole with a casing string section or may be run downhole after the deployment of the casing string. Next, the casing string 24 is cemented (block 44) in place. Subsequently, the well is perforated (block 46). A fluid efficiency test is then performed (block 48) on the well using the distributed temperature sensor (such as the optical fiber 20) and any corrective action that is needed is taken (block 50). This fluid efficiency test includes introducing the test fluid into the well. After any corrective action, the technique 40 also includes performing (block 52) subsequent fracturing of the well.

Alternatively, the conduit 23 may be run into the well without the optical fiber 20. In this manner, the optical fiber 20 may be run into the conduit 23 by pumping a fluid into the conduit 23 after the casing and conduit 23 are cemented in place. The technique of pumping the fiber 20 into a conduit by fluid drag is described in United States Reissue Patent No. 37,283.

Figure 7:
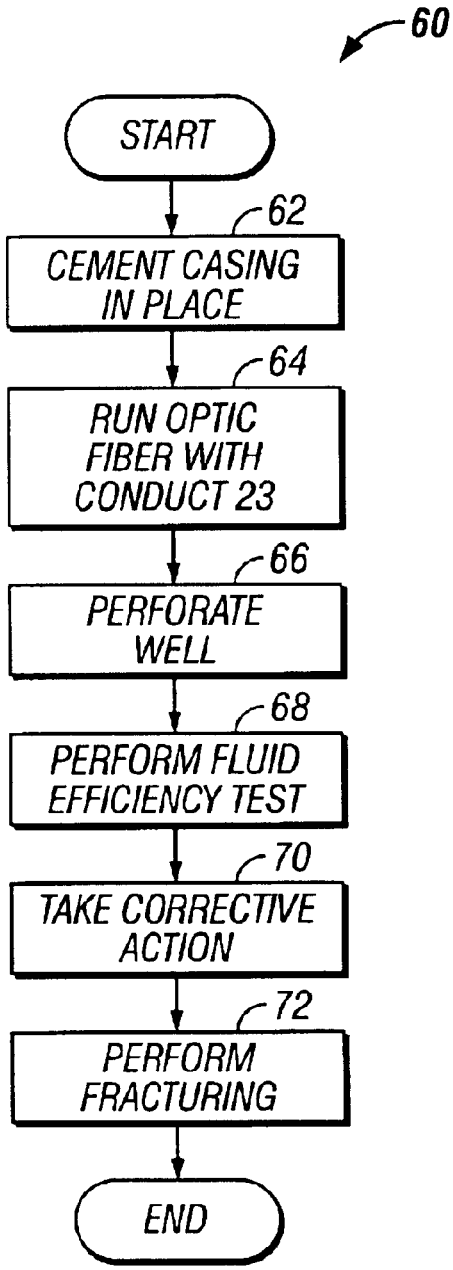

Referring to FIG. 7, in another embodiment of the invention, a technique 60 may be used. Unlike the technique 40, the technique 60 includes placing the conduit 23 in the central passageway of the casing string 24. In this manner, in the technique 60, the casing string 24 is cemented (block 62) in place. Subsequently, the optical fiber 20 is run (block 64) with the conduit 23 downhole. Alternatively, the optical fiber 20 may be run into the conduit 23 via pumped fluid, as previously described, after the conduit 23 is run downhole. Next, the technique 60 includes perforating (block 66) the well. Subsequently, a fluid efficiency test (that includes introducing the test fluid) is performed (block 68) on the well, and any corrective action that is needed is taken (block 70). Fracturing is subsequently performed, as depicted in block 72.

Figure 8:
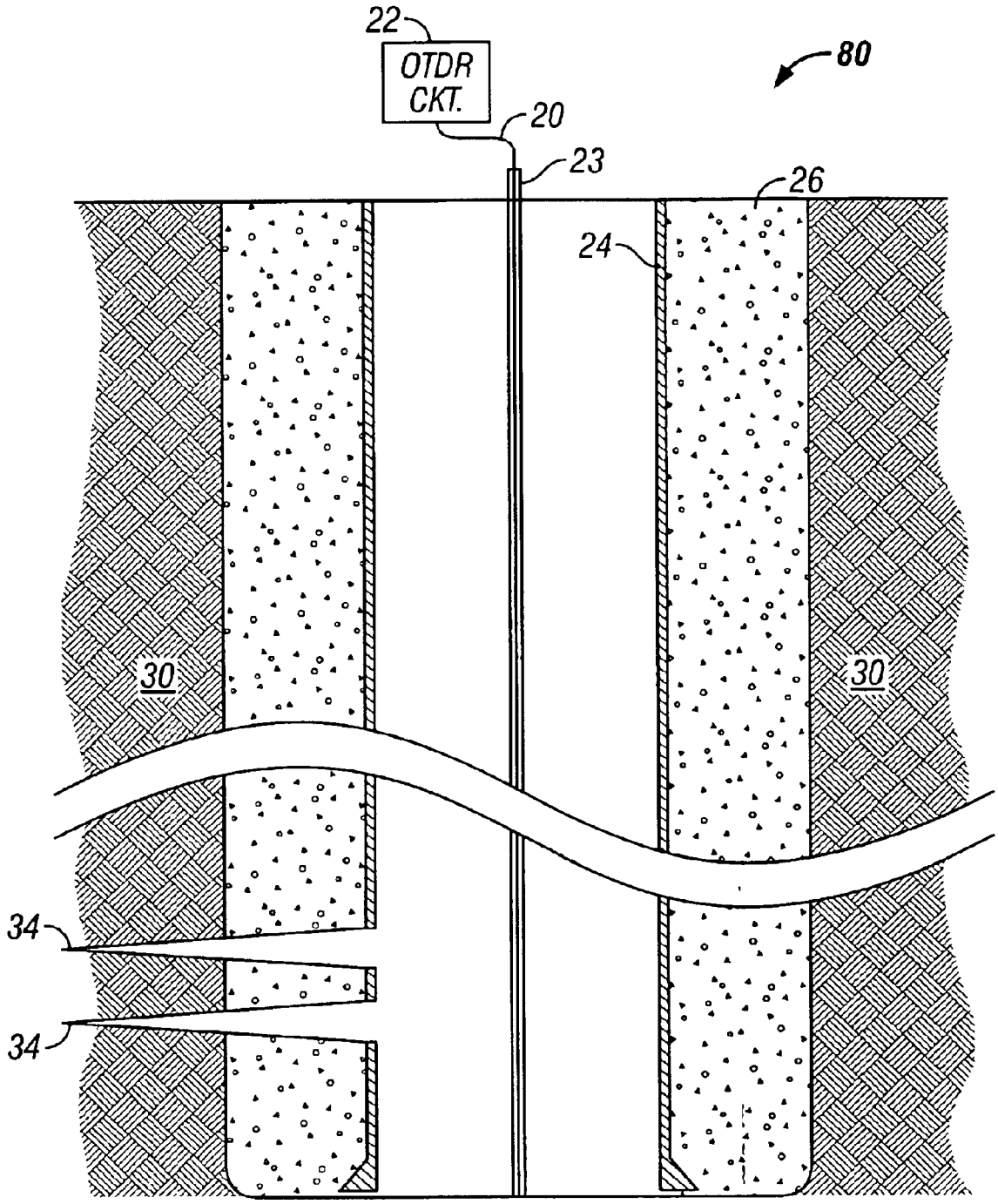

FIG. 8 depicts a system 80 in accordance with the technique 60. In this manner, the conduit 23 (containing the optical fiber 20) is disposed inside a central passageway of the well casing string 24, and the upper end of the optical fiber 20 is optically coupled to the OTDR circuit 22.

Figure 9:
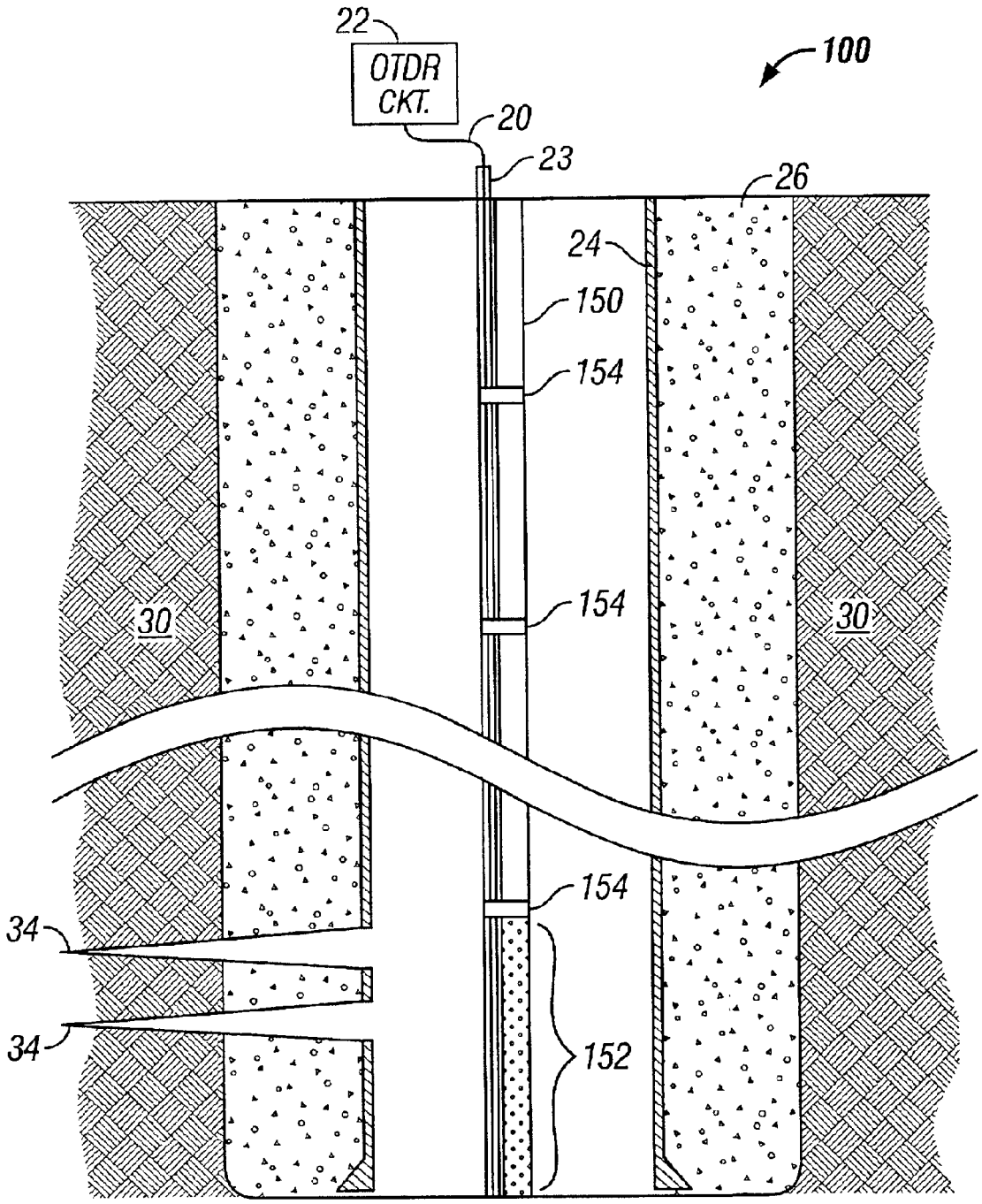

FIG. 9 depicts another system 100 in which the conduit 23 is located inside the central passageway of the casing string 24. However, in the system 100, the conduit 23 is attached to another tubing 150 that extends downhole. In this manner, in the system 100, the conduit 23 may be attached via clamps or bands 154 (for example) to the tubing 150. As an example, the tubing 150 may be used for purposes of introducing the test fluid into the well, communicating other fluid downhole, controlling a downhole tool, etc.

In some embodiments of the invention, the tubing 150 includes a perforated tail pipe section 152 that extends across the relevant zone or zones. In some embodiments of the invention, the conduit 23 is placed in a position such that the perforation tunnels of the well, such as the perforation tunnels 34, do not coincide with the conduit 23. As an example, test fluid may be delivered into the well via the perforated tail piper section 152. Furthermore, fracturing fluid may subsequently be communicated into the well via the section 152.

Other embodiments are within the scope of the following claims. For example, in some embodiments of the invention, a distributed temperature sensor may be deployed in a lateral well bore. Other variations are possible.

While the present invention has been described with respect to a limited number of embodiments, those skilled in the art, having the benefit of this disclosure, will appreciate numerous modifications and variations therefrom. It is intended that the appended claims cover all such modifications and variations as fall within the true spirit and scope of this present invention.

What is claimed is:

1. A method usable with-a subterranean well, comprising:

before performing any fracturing operation in the well, introducing a fluid into the well in connection with a fluid efficiency test;

measuring a temperature versus depth distribution along a section of the well in response to the introduction of the fluid; and performing an initial fracturing operation in the well after the measuring.

2. The method of claim 1, further comprising:

taking corrective action in response to a result obtained from the measurement.

3. The method of claim 1, further comprising:

using the measurement to observe a transient temperature response of the well to the introduction of the fluid.

4. The method of claim 1, further comprising:

performing a fracturing operation after the measuring.

5. The method of claim 4, wherein the performing comprises:

pressurizing another fluid to a predetermined level.

6. The method of claim 1, wherein the section spans across at least one zone.

7. The method of claim 6, wherein the zone comprises one of a production zone and an injection zone.

8. The method of claim 1, wherein the section spans across at least two zones.

9. The method of claim 8, wherein the zones comprise one of production zones and injection zones.

10. The method of claim 8, wherein the measured temperature versus depth distribution spans across each of said at least two production zones.

11. The method of claim 1, further comprising:

using the distribution to determine a volume capacity along the section.

12. The method of claim 1, further comprising:

deploying an optical fiber downhole to extend at least along the section, and using the optical fiber to measure the temperature versus depth distribution.

13. The method of claim 12, further comprising:

deploying the optical fiber inside a well casing string of the well.

14. The method of claim 12, further comprising:

deploying the optical fiber in an annulus surrounding a casing string of the well.

15. The method of claim 14, further comprising:

introducing cement into the annulus to secure the casing string in place.

16. The method of claim 12, further comprising:

deploying the optical fiber inside a conduit that extends downhole.

17. The method of claim 16, further comprising:

deploying the optical fiber with the conduit downhole into the well.

18. The method of claim 16, further comprising:

deploying the optical fiber downhole into the well after the deployment of the conduit.

19. The method of claim 16, further comprising:

attaching the conduit to another conduit that extends downhole into the well.

20. The method of claim 16, further comprising:

deploying the conduit inside an annulus outside of a casing string of the well.

21. The method of claim 16, further comprising:

deploying the conduit inside a casing string of the well.

22. The method of claim 1, further comprising:

communicating light pulses into an optical fiber to produce backscattered light; and using optical time domain reflectometry to derive the temperature versus depth distribution.

23. The method of claim 1, wherein the fluid does not contain proppant.

24. A method usable with a subterranean well, comprising:

before performing any fracturing operation in the well, introducing a fluid into the well;

measuring a temperature versus depth distribution along a section of the well in response to the introduction of the fluid; and performing an initial fracturing operation in the well in response to the measuring.

25. The method of claim 24, further comprising:

taking corrective action in response to a result obtained from the measurement.

26. The method of claim 25, wherein the corrective action occurs before the performance of the fracturing operation.

27. The method of claim 25, wherein the section spans across at least one zone.

28. The method of claim 27, wherein the zone comprises one of a production zone and an injection zone.

29. The method of claim 27, wherein the section spans across at least two zones.

30. The method of claim 29, wherein the zones comprise one of production zones and injection zones.

31. The method of claim 29, wherein the measured temperature versus depth distribution spans across each of said at least two zones.

32. The method of claim 24, further comprising:

using the measurement to observe a transient temperature response of the well to the introduction of the fluid.

33. The method of claim 24, further comprising:

using the distribution to determine a volume capacity along the section.

34. The method of claim 24, further comprising:

deploying an optical fiber downhole to extend at least along the section, and using the optical fiber to measure the temperature versus depth distribution.

35. The method of claim 34, further comprising:

deploying the optical fiber inside a well casing string of the well.

36. The method of claim 34, further comprising:

deploying the optical fiber in an annulus surrounding a casing string of the well.

37. The method of claim 36, further comprising:

introducing cement into the annulus to secure the casing string in place.

38. The method of claim 34, further comprising:

deploying the optical fiber inside a conduit that extends downhole.

39. The method of claim 38, further comprising:

deploying the optical fiber with the conduit downhole into the well.

40. The method of claim 38, further comprising:

deploying the optical fiber downhole into the well after the deployment of the conduit.

41. The method of claim 38, further comprising:

attaching the conduit to another conduit that extends downhole into the well.

42. The method of claim 38, further comprising:

deploying the conduit inside an annulus outside of a casing string of the well.

43. The method of claim 38, further comprising:

deploying the conduit inside a casing string of the well.

44. The method of claim 34, further comprising:

communicating light pulses into the optical fiber to produce backscattered light; and using optical time domain reflectometry to derive the temperature versus depth distribution.

45. The method of claim 24, wherein the fluid does not contain proppant.

46. A system usable with a subterranean well, comprising:

a sensor disposed in the well; and a circuit coupled to the sensor to, in response to a fluid efficiency test being conducted in the well, receive an indication from the sensor of a temperature versus depth distribution along a section of the well and indicate a volume capacity along the section.

47. The system of claim 46, wherein the section spans across at least one production zone.

48. The system of claim 46, wherein the section spans across at least two production zones.

49. The system of claim 48, wherein the indicated temperature versus depth distribution spans across each of said at least two production zones.

50. The system of claim 46, wherein the sensor indicates a temperature of a formation rock.

51. The system of claim 46, wherein the sensor comprises an optical fiber.

52. The system of claim 46, wherein the sensor is deployed inside a well casing string of the well.

53. The system of claim 46, wherein the sensor is deployed in an annulus surrounding a casing string of the well.

54. The system of claim 53, wherein the sensor is surrounded by cement used to secure the casing string in place.

55. The system of claim 46, wherein the sensor is deployed inside a conduit that extends downhole.

56. The system of claim 55, wherein the conduit is deployed inside an annulus outside of a casing string of the well.

57. The system of claim 46, wherein the sensor is deployed inside a casing string of the well.

58. The system of claim 46, wherein the sensor comprises an optical fiber and the circuit is adapted to:

communicate light pulses into the optical fiber to produce backscattered light, and use optical time domain reflectometry to derive the temperature versus depth distribution.

59. The system of claim 46, wherein the fluid does not contain proppant.

60. A method usable with a subterranean well, comprising:

introducing a fluid into the well in connection with a fluid efficiency test;

measuring a temperature versus depth distribution along a section of the well in response to the introduction of the fluid; and using the distribution to determine a volume capacity along the section.

61. The method of claim 60, further comprising:

taking corrective action in response to a result obtained from the measurement.

62. The method of claim 60, further comprising:

using the measurement to observe a transient temperature response of the well to the introduction of the fluid.

63. The method of claim 60, further comprising:

deploying an optical fiber downhole to extend at least along the section, and using the optical fiber to measure the temperature versus depth distribution.

64. The method of claim 63, further comprising:

deploying the optical fiber inside a well casing string of the well.

65. The method of claim 63, further comprising:

deploying the optical fiber in an annulus surrounding a casing string of the well.

66. The method of claim 63, further comprising:

deploying the optical fiber inside a conduit that extends downhole.

67. The method of claim 60, further comprising:

communicating light pulses into an optical fiber to produce backscattered light; and using optical time domain reflectometry to derive the temperature versus depth distribution.

68. A method usable with a subterranean well, comprising:

introducing a fluid into the well;

measuring a temperature versus depth distribution along a section of the well in response to the introduction of the fluid;

performing a fracturing operation after the measuring; and using the distribution to determine a volume capacity along the section.

69. The method of claim 68, further comprising:

taking corrective action in response to a result obtained from the measurement.

70. The method of claim 69, wherein the corrective action occurs before the performance of the fracturing operation.

71. The method of claim 68, further comprising:

using the measurement to observe a transient temperature response of the well to the introduction of the fluid.

72. The method of claim 68, further comprising:

deploying an optical fiber downhole to extend at least along the section, and using the optical fiber to measure the temperature versus depth distribution.

73. The method of claim 68, further comprising:

communicating light pulses into an optical fiber to produce backscattered light; and using optical time domain reflectometry to derive the temperature versus depth distribution.

* * * * *